United States Patent [19]

Caso

[11] 4,170,242

[45] Oct. 9, 1979

[54] BODY SUPPORTED CANOPY

[76] Inventor: Felipe S. Caso, 1182 Florida, Corpus Christi, Tex. 78404

[21] Appl. No.: 838,218

[22] Filed: Sep. 30, 1977

[51] Int. Cl.[2] ..... A45B 11/02

[52] U.S. Cl. ..... 135/5 C; 135/7.1 R; 224/190

[58] Field of Search ..... 135/5 C, 6, 7.1 R, 5 D, 135/5.3, 5 R; 224/5.1; 297/184; 5/113

[56] References Cited

U.S. PATENT DOCUMENTS

| | | | |
|---|---|---|---|
| 229,465 | 6/1880 | Ray | 135/5 C |
| 229,912 | 7/1880 | Ray | 135/5 C |
| 397,172 | 2/1889 | Dean | 135/5 C |
| 578,572 | 3/1897 | Lashells | 224/5.1 |
| 617,571 | 1/1899 | Harlow | 135/6 |
| 714,650 | 11/1902 | Truscott et al. | 135/6 |
| 728,505 | 5/1903 | Seeger | 224/5.1 |
| 1,281,691 | 10/1918 | Stockwell | 135/5 R |
| 1,491,306 | 4/1924 | Kirkham | 135/5 C |
| 1,627,847 | 5/1927 | Harold | 135/5 C |
| 1,803,538 | 5/1931 | Pistole | 224/5.1 |
| 2,769,451 | 11/1956 | Edgin | 135/6 |
| 3,032,046 | 5/1962 | Coonradt | 135/6 |
| 3,955,228 | 5/1976 | Gaschenko et al. | 135/6 |

*Primary Examiner*—C. J. Husar
*Assistant Examiner*—Conrad Berman
*Attorney, Agent, or Firm*—G. Turner Moller

[57] ABSTRACT

There is disclosed a body supported canopy comprising a rigid framework supported from the hips and shoulders of a user. The framework comprises a pair of upstanding members to which are independently affixed a pair of generally U-shaped members comprising an articulated frame for a bodily flexible non-transparent cover. The forwardly directed U-shaped member is braced by a pair of toggle links in a forwardly directed position generally perpendicular to the upstanding members. Breaking of the toggle links allows pivotal movement of the forwardly directed cover between the operative position and a storage position generally parallel to the body carried framework. The rearwardly directed U-shaped member is free to move between a storage position generally parallel to the body carried framework and a transverse position. A tether constrains movement of the second U-shaped member to a position generally perpendicular to the body carried framework.

3 Claims, 3 Drawing Figures

BODY SUPPORTED CANOPY

This invention relates to body supported canopies and particularly to a body supported canopy or sun shade of the type which frees the hands of the wearer in the operative position and is capable of convenient collapsing movement into a storage configuration.

Body supported canopies which leave the hands of the wearer free and are capable of collapsing movement into a storage position are known in the prior art as shown in U.S. Pat. Nos. 229,465; 229,912; 397,172; 728,505; and 1,803,538.

The body supported canopy of this invention comprises a body carried support similar to a back pack comprising a waist or hip engaging support having belt ends thereon and an upstanding framework having a pair of shoulder straps secured thereto. The framework includes a pair of laterally spaced upstanding members. An articulated canopy frame is mounted on the upper ends of the upstanding members and includes a first generally U-shaped member pivotally connected at the ends thereof to one of the upstanding members and extending forwardly in the direction of travel of the user. A second similar generally U-shaped member is pivotally connected, independently of the first U-shaped member at opposite ends thereof to the upstanding framework members and extends rearwardly or oppositely from the first U-shaped member. Suitable toggle links are provided to support the forwardly extending U-shaped member in a generally horizontal operative position and are capable of unlatching to allow movement of the first U-shaped member into a position generally parallel to the framework. The second U-shaped member is free to move between positions generally transverse to the framework and generally parallel thereto. A bodily flexible non-transparent cover is provided having a first planar section supported by the first U-shaped member and a second planar section supported by the second U-shaped member. The canopy of this invention is accordingly capable of being worn or supported by a user in order to free the user's hands for other purposes and can be readily collapsed to a compact storage configuration.

It is accordingly apparent that one object of this invention is to provide a body carried canopy which can conveniently be collapsed into a compact storage configuration.

Other objects and a fuller understanding of this invention may be had by referring to the following description and claims taken in conjunction with the accompanying drawings.

Figure 1:
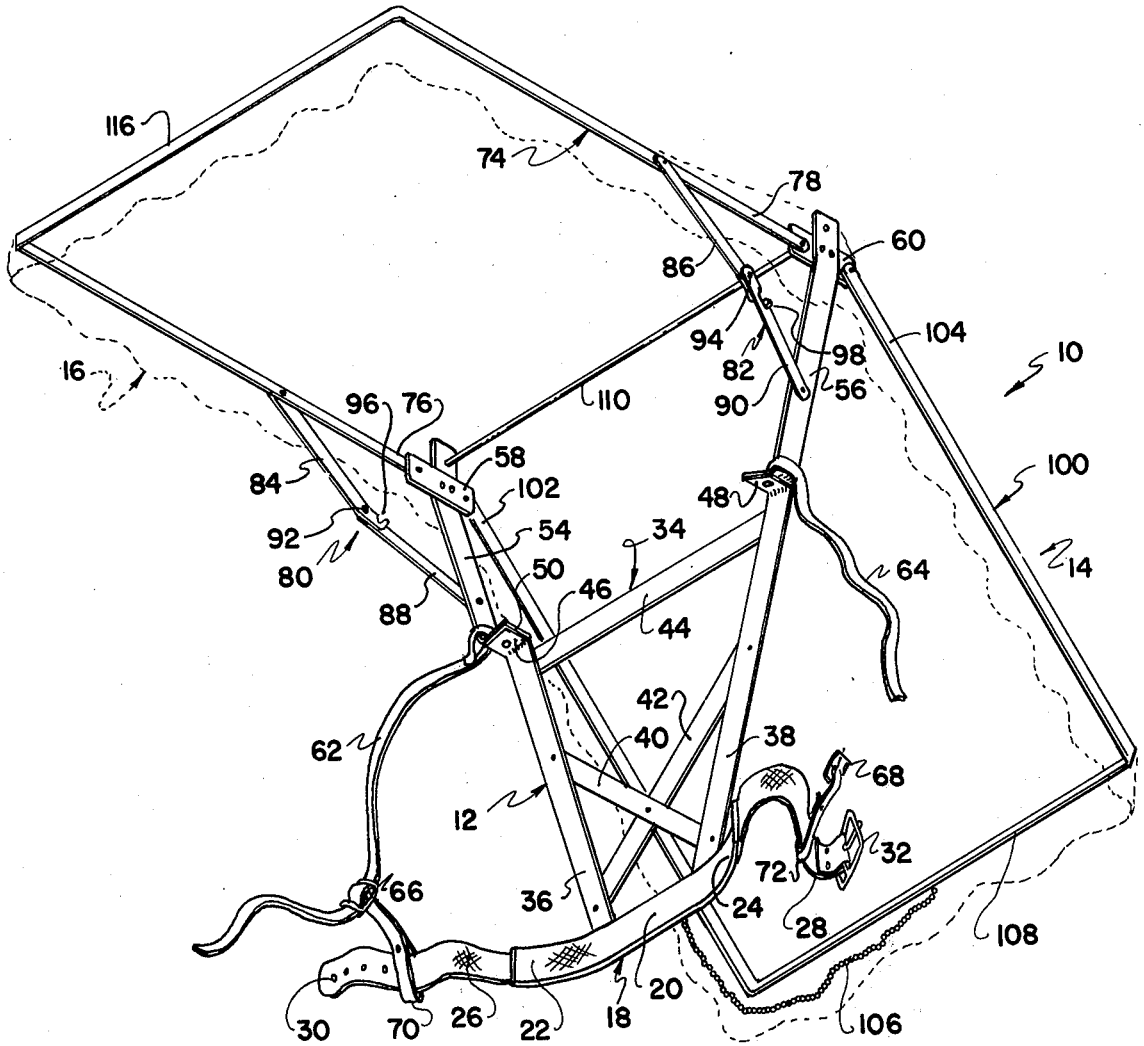
FIG. 1 is an isometric view of the body carried canopy of this invention.
Figure 2:
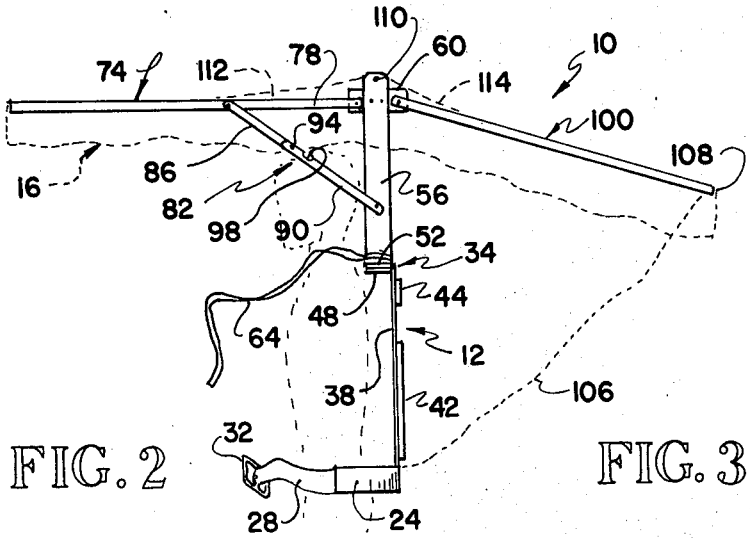
FIG. 2 is a side elevational view of the canopy of FIG. 1 illustrated in the operative position.
Figure 3:
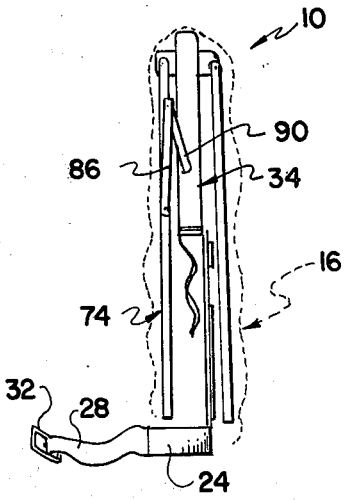
FIG. 3 is a side elevational view of the canopy of FIG. 1 illustrating the canopy of this invention in the storage configuration.

Referring to FIGS. 1–3, the canopy 10 of this invention comprises, as major components, a body carried support 12, an articulated canopy frame 14 and a bodily flexible non-transparent cover 16.

The support 12 comprises an arcuate generally concave waist or hip engaging section 18 including a generally planar back engaging segment 20 and a pair of arcuate wings or ends 22, 24. The section 18 is preferably substantially rigid and may be made of metal or plastic and is desirably covered with a resilient material, such as rubber or the like, for the comfort of the user. The section 18 is accordingly concave in the direction of forward movement of the user. A pair of belt ends 26, 28, respectively, provide a plurality of eyes 30 and a buckle 32 and are connected to the sections ends 22, 24 for temporarily attaching the support 12 to the user's body.

The support 12 also comprises a framework 34 secured to the section 18 including a first pair of generally upstanding members 36, 38 braced by a plurality of suitable struts 40, 42. A generally horizontal brace 44 is connected to the upstanding members 36, 38 at a location vertically above the tops of the struts 40, 42. It will be noted that the upstanding members 36, 38, the struts 40 42 and the brace 44 present a flat side adjacent the back of the user. The first upstanding members 36, 38 terminate in a forwardly extending generally horizontal leg 46, 48 connected to a similar horizontal leg 50, 52 provided by a second pair of generally upstanding members 54, 56. The second upstanding members 54, 56 are generally perpendicular to the members 36, 38 for purposes more fully explained hereinafter. Attached to the upper end of each of the members 54, 56 is a crosspiece 58, 60 which provides support for the articulated canopy frame 14.

The support 12 also comprises a pair of shoulder straps 62, 64 affixed to the framework 34. The opposite end of the shoulder straps 62, 64 is connected in any suitable manner to the support 12, as by attachment to a buckle 66, 68 carried by a loop 70, 72 received on the belt ends 26, 28 respectively.

The canopy frame 14 comprises a first generally U-shaped member 74 including a pair of legs 76, 78 mounted on the crosspieces 58, 60. In the operative position shown in FIG. 2, the first U-shaped member 74 extends generally horizontally forwardly or in the direction of concavity of the waist engaging section 18. The first U-shaped member is supported in the horizontal position by a pair of toggle links 80, 82 comprising first links 84, 86 removably pinned to the legs 76, 78 and second links 88, 90 pinned to the upstanding members 54, 56. The links 84, 88 and 86, 90 are pivoted together by suitable pins 92, 94. A catch 96, 98 on the first links 84, 86 limits movement of the toggle links 80, 82 in one direction to the position shown in FIG. 2 while allowing collapsing movement in the other direction as shown in FIG. 3. Because the members 54, 56 present the flat side thereof to the side, the toggle links 80, 82 connect thereto conveniently and are capable of collapsing movement to a position generally parallel thereto.

The canopy frame 16 also includes a second U-shaped member 100 comprising legs 102, 104 pivotally connected to the crosspieces 58, 60 independently of the first U-shaped member 74. The second U-shaped member 100 is free to pivot with respect to the framework 34 from a position parallel thereto as shown in FIG. 3 to a position generally transverse thereto as shown in FIG. 2. A flexible tether 106, such as a light chain or rope, connects the framework 34 to the bight 108 of the U-shaped member 100. The tether 106 acts as a constraint to prevent the member 100 from being blown in a counterclockwise direction, as viewed in FIG. 2, over the top of the member 74.

As will be apparent in FIG. 2, the crosspieces 58, 60 are disposed below the extreme top of the upstanding members 54, 56. A removable rod 110 is secured between the members 54, 56 at the extreme upper end thereof for purposes more fully explained hereinafter.

The cover 16 may be made of any suitable non-transparent material, such as fabric or sheet plastic, that is sufficient to provide shade from the sun. The cover 16 is desirably of one piece construction having a first generally planar section 112 supported by the first U-shaped member 74 and a second generally planar section 114 supported by the second U-shaped member 100. The first and second planar sections 112, 114 conveniently comprise channels or passages for the bights 108, 116 and for a portion of the legs 76, 78, 102, 104. As is shown best in FIG. 2, the removable rod 110 extends through a channel (not shown) in the cover 16 and slightly elevates the central portion of the cover 16 in order to avoid interference between the cover 16 and the pivoting members 74, 100.

In order to remove the cover 16, the rod 110 is removed from the canopy frame 14, the links 84, 86 are unpinned from the legs 76, 78 and the tether 106 is uncoupled from the U-shaped member 100. The U-shaped members 74, 100 are then folded into a generally parallel position opposite from the framework 34 and the cover 16 is slid off of the frame 14. Replacement of the cover 16 is, of course, in a reverse fashion.

The use of the canopy 10 should now be apparent. As shown in FIG. 2, the user attaches the support 12 in much the same manner that a back pack is attached. The horizontal legs 46, 48, 50, 52 are disposed slightly above shoulder level on opposite sides of the wearer's head. The U-shaped member 100 typically extends generally vertically or parallel to the framework 34.

In order to store the canopy 10, the toggle links 80, 82 are broken allowing the first U-shaped member 74 to pivot into a position generally parallel to the framework 34 as shown best in FIG. 3.

Although the invention has been described in its preferred form with a certain degree of particularity, it is understood that the present disclosure has been made only by way of example and that numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exists in the invention disclosed.

I claim:

1. A body carried canopy comprising a body carried support including a waist band having a generally concave section having an open side and a belt end secured to opposite sides of the concave section, an upstanding framework affixed to the concave section having a first pair of upstanding members on opposite sides of the section providing generally parallel first flat surfaces extending in a plane tangent to the concave section and a second pair of upstanding members comprising extensions of the first upstanding members and having second flat surfaces generally perpendicular to the first surfaces, and a pair of shoulder straps secured to the framework;

an articulated canopy frame including a first generally U-shaped member having generally first legs and a bight, means pivotally connecting the first legs to the upstanding members for movement in a path between a position generally parallel to the framework adjacent the concave side of the section and a position generally transverse to the framework, a second generally U-shaped member having generally parallel second legs and a bight, and means pivotally connecting the second legs to the upstanding members independently of the first legs for movement in a path between a position generally parallel to the framework on the opposite side thereof from the first legs and a position generally transverse to the framework;

means for supporting the first U-shaped member in a position generally transverse to the framework and means for deactivating the supporting means for allowing the first U-shaped member to move to a position generally parallel to the framework, the supporting means comprises a pair of toggle braces connecting each leg of the first U-shaped member to adjacent second upstanding members of the framework for movement in a path generally parallel to the second upstanding members;

the second U-shaped member being free to move between a position generally transverse to the framework and a position generally parallel to the framework; and a bodily flexible non-transparent cover having a first planar section supported by the first U-shaped member and a second planar section supported by the second U-shaped member.

2. A body carried canopy comprising:

a body carried support including a waistband having a generally concave section having an open side and a belt end secured to opposite sides of the concave section, an upstanding framework affixed to the concave section having upstanding members on the opposite sides of the section including flat coplanar first sections secured to the concave section, each comprising a generally transverse first foot and flat second sections each comprising a generally transverse second foot parallel to the first foot and means connecting the feet together, and a pair of shoulder straps secured to the framework;

an articulated canopy frame including a first generally U-shaped member having generally parallel first legs and a bight, means pivotally connecting the first legs to the upstanding members for movement in a path between a first position generally parallel to the framework adjacent the concave side of the section and a second position generally transverse to the framework, a second generally U-shaped member having generally parallel second legs and a bight, means pivotally connecting second legs to the upstanding members independently of the first legs for movement in a path between a third position generally parallel to the framework adjacent the opposite side thereof from the first legs and a fourth position generally transverse to the framework;

means for supporting the first U-shaped member in the second position generally transverse to the framework and means for deactivating the supporting means for allowing the first U-shaped member to move to the first position generally parallel to the framework adjacent the concave side of the section;

the second U-shaped member being free for movement between the fourth position generally transverse to the framework and the third position generally parallel to the framework adjacent to the opposite side thereof from the first leg; and a bodily flexible non-transparent cover having a first planar section supported by the first U-shaped member and a second planar section supported by the second U-shaped member.

3. The canopy of claim 2 wherein the first sections and the second sections of opposite upstanding members converge toward the concave section.

* * * * *